United States Patent [19]

Darlington

[11] 4,338,910

[45] Jul. 13, 1982

[54] COMPOUND BOW WITH CENTER TENSION PULLEY

[76] Inventor: Rex F. Darlington, 3540 Darton Rd., Hale, Mich. 48739

[21] Appl. No.: 134,195

[22] Filed: Mar. 27, 1980

[51] Int. Cl.[3] ..... F41B 5/00

[52] U.S. Cl. ..... 124/24 R; 124/90

[58] Field of Search ..... 124/24 R, 23 R, 90, 124/86

[56] References Cited

U.S. PATENT DOCUMENTS 4,079,723 3/1978 Darlington ..... 124/90 X 4,187,826 2/1980 Killian ..... 124/24 R

*Primary Examiner*—Richard C. Pinkham

*Assistant Examiner*—William R. Browne

*Attorney, Agent, or Firm*—Barnes, Kisselle, Raisch & Choate

[57] ABSTRACT

A compound bow having multiple pulley sheaves on a common axis at each distal end of the bow limbs, the sheaves having a cross-over groove which carries the bow string to the center of the bow limb during the draw of an arrow to prevent a twisting torque on the bow limbs at the periods of greatest stress and bending of the limbs.

6 Claims, 5 Drawing Figures

COMPOUND BOW WITH CENTER TENSION PULLEY

FIELD OF INVENTION

Archery bows of the compound type with overcenter pulleys to relieve aiming pull for archer.

BACKGROUND OF THE INVENTION

Archery bows of the compound type have become popular since 1969 when the Allen U.S. Pat. No. 3,486,495, issued in the United States. These bows are designed with eccentric pulleys at the end of the bow limbs so that the pull exerted by the archer decreases about half way through the draw. This enables the archer to maintain the draw without the excessive arm tension usually needed and thus makes it easier to aim the arrow prior to release.

The use of the pulleys on the bow limbs has resulted in anchor points and plural pulleys along an axis. Due to the nature of the cables and anchor points, there may be at least three pressure lines on a bow limb. If the tension at these three lines is not equal, there may be a tendency to twist the bow limbs especially during the periods of highest tension when the arrow is drawn.

One design to centralize the maximum tension is disclosed in a U.S. Pat. No. 4,079,723, dated Mar. 21, 1978. The present invention is an improved pulley construction which equalizes or balances the cable and pulley loads under all conditions of the bow operation. In a released position, the three-cable loads are substantially equally distributed along the pulley axis at the end of the limbs. In the full draw state, the main bowstring carrying the highest tension is moved to the center of the pulley axis and thus is central to the bow limb. There is, therefore, no twisting reaction on the bow limb itself and the release is smooth and without a torque reaction.

It is, therefore, an object of the present invention to provide a bow construction for compound, eccentric pulley bows which transfers the main bowstring tension to the center of the bow limb at drawn conditions to avoid twisting torque on the bow limbs.

It is a further object to provide a compound bow with pulleys which can be used at each end of the bow without alteration and which can be used with optional eccentricity dimensions.

Other objects and features of the invention will be apparent in the following description and claims in which the principles of the invention are set forth together with the manner and process of using the invention directed to persons skilled in the art, all in connection with the best mode presently contemplated for the invention.

Figure 1:
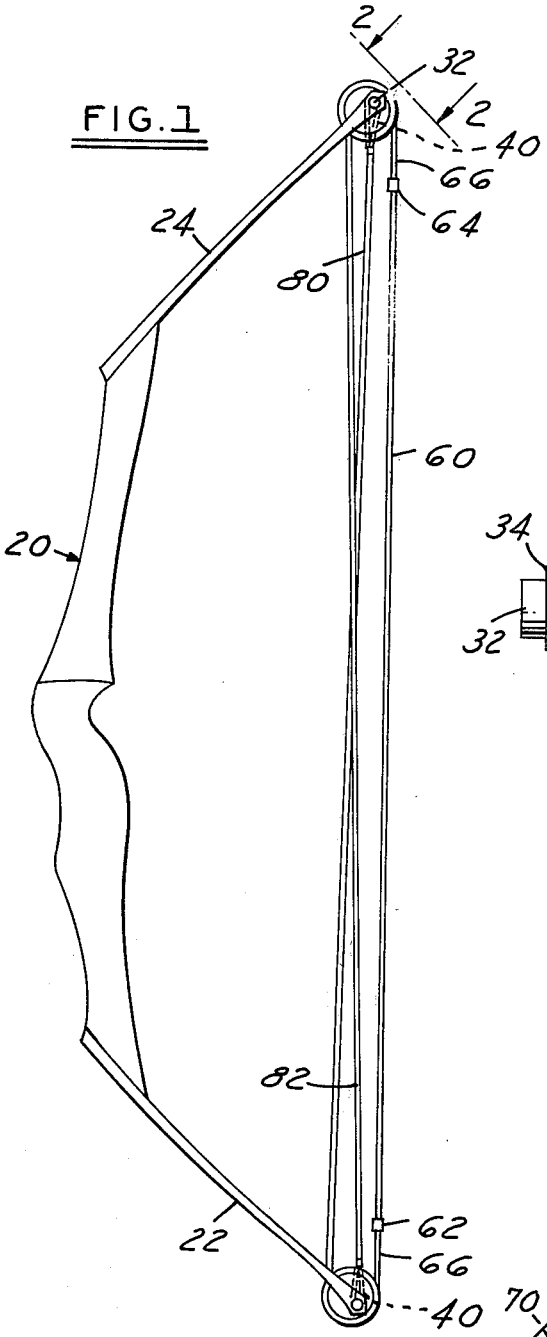

Drawings accompany the disclosure and the various views thereof may be briefly described as:

FIG. 1, a side view of a compound bow using the present invention.

Figure 2:
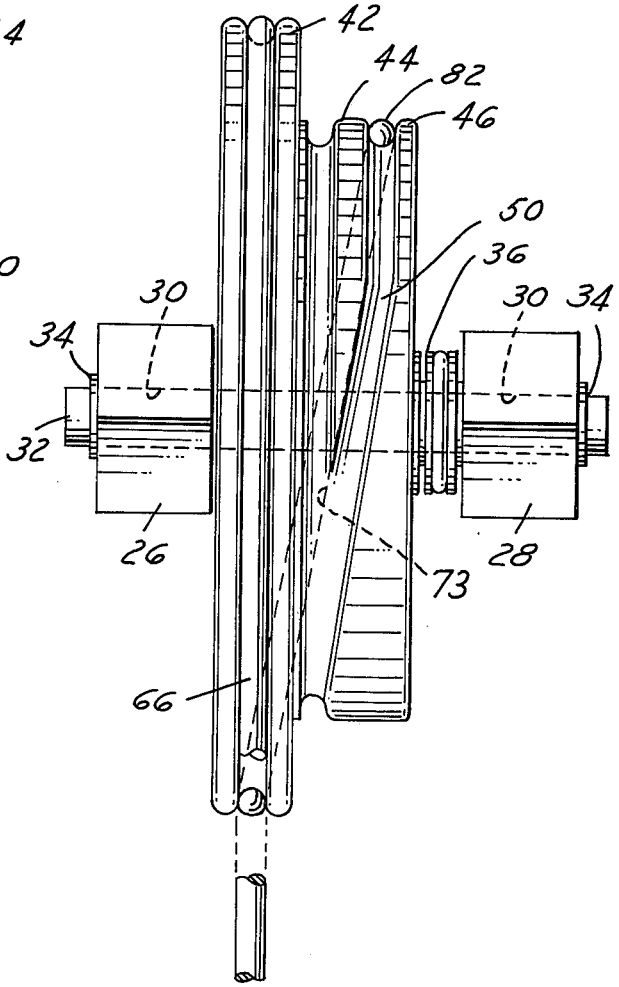

FIG. 2, an enlarged view of a bow end on line 2—2 of FIG. 1.

Figure 3:
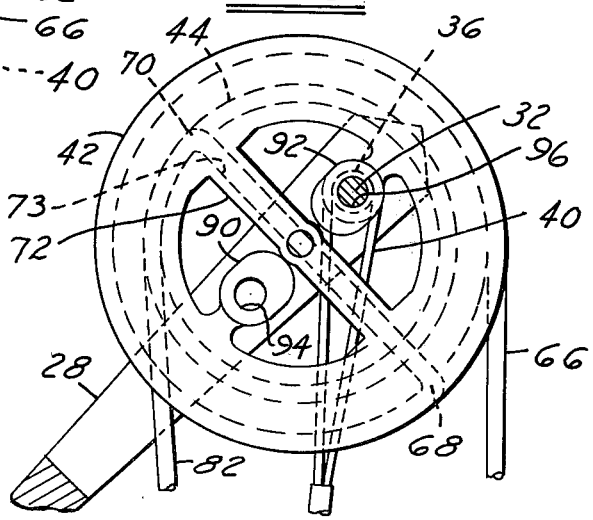

FIG. 3, a side view of a pulley at one end of the bow.

Figure 4:
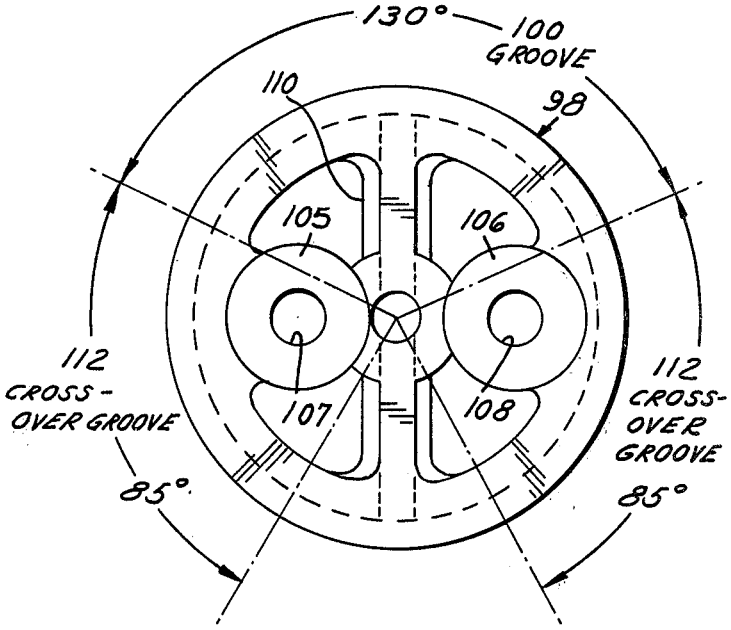

FIG. 4, a side view of a modified pulley construction with equal diameters.

Figure 5:
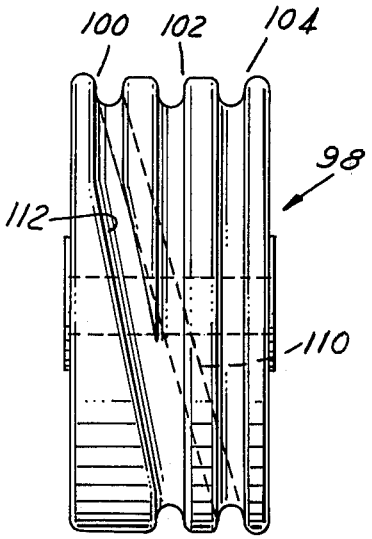

FIG. 5, an elevation of the pulley sheaves of the modification of FIG. 4.

There are compound bow pulleys which utilize a helical track to shift cable stress axially and the present invention is an improvement over these previous designs.

In the present invention disclosure, a compound bow is illustrated in FIG. 1 with a bow handle and grip 20 and flexing bow limbs 22 and 24 mounted on the handle either in a fixed position or with an adjustable connection in the usual fashion. The distal end of each bow limb is bifurcate in construction to provide spaced arms 26 and 28 each having aligned shaft holes 30 to accommodate a shaft 32 bridging the two arms and retained by split rings 34 in grooves in the shaft.

A small anchor sheave 36 is mounted on shaft 32 spaced by suitable washers and serves as an anchor for a loop 40 at one end of a cable. The other end of the bow has an identical construction.

Also on the shaft 32 is an eccentrically mounted triple sheave pulley having a large diameter pulley bow string sheave 42, an intermediate pulley sheave 44 of smaller diameter, and an outside cable run pulley sheave 46 of the same diameter as the intermediate pulley. All of the pulley sheaves 42, 44 and 46 are integral in that they turn together on the shaft 32 as a composite pulley unit. The grooves in sheaves 42 and 44 extend a full 360°. The arcuate extent of transition grooves 50 is about 85° while the groove in sheave 46 between the transition grooves has an arcuate extent of about 130°. (See FIG. 4).

It will be noted in FIG. 2 that there is a switch over groove 50 from the groove of cable run sheave 46 to the groove of intermediate sheave 44. The function of this switch over groove will be explained later.

The stringing of the bow includes an arrow bowstring 60 which is looped at each end to engage floating miniature cleats 62 and 64 attached to each end of a cable 66. This cable 66 passes over bowstring sheave 42 to a point 68 where it plunges diametrically, FIG. 3, into the sheave 42 and also crosses axially to cable run sheave 46 exiting at 70 to the groove of sheave 46. Thus, in the at-rest position, the sheave 42 is occupied and sheave 46 is occupied and intermediate sheave 44 is empty. A diametrical passage 73 in a diametrical spoke 72 in the composite pulley accommodates the cable changeover from sheave 42 to sheave 46.

The cable 66 has two stretches or runs between the limb ends. From an anchor loop 40 at the top of the bow, as viewed in FIG. 1, the cable extends down in a run 80 to sheave 46 in the lower composite sheave and then diametrically and axially to sheave 42 at point 68. Similarly, from anchor loop 40 at the bottom of the bow, the cable extends upwardly in a run 82 to cable run sheave 46 at the top composite sheave and then diametrically and axially to bowstring sheave 42. These two runs 80 and 82 cross centrally of the bow but both are spaced laterally to the right of the bowstring 60 so that they do not interfere with the arrow flight.

Each composite pulley, as viewed in FIG. 3, has two spokes 90 and 92 on a common diameter at right angles to the spoke 72, these spokes 90 and 92 being relatively wide to have formed thereon holes 94 and 96 to receive selectively the mounting shaft 32. The holes 94 and 96 are spaced at different dimensions from the center of the pulley so that different eccentricities may be obtained depending on the hole selected. For example, in a sheave where the larger sheave has a root diameter of about 2 17/32" and the smaller sheaves are $2\frac{7}{8}$" in diameter, the centers of the holes in spokes 90 and 92 can be spaced, respectively, 1 1/16" and 31/32" from the center. These dimensions control the amount of reduction in the draw pull at full draw such as 50% reduction or a 35% reduction depending on the eccentricity selected. The size of the sheave 42 controls the length of the draw. The larger is this pulley, the longer is the draw without altering the stress on the cable 66. It will be noted that the pulleys are mounted at each end in symmetrical relation with the exception of the axle shaft holes, the sheave 42 being on the left in each case. The pulleys may be switched from end to end to use opposite axle holes for differing eccentricity and may rotate in opposite directions utilizing one or the other of transition grooves from sheave 46 to sheave 44.

When an arrow is notched in the bowstring 60 and the bowstring pulled back to a release position, the pulleys at each end will rotate. The top pulley will move clockwise and the bottom pulley will move counterclockwise.

In the at-rest position prior to the pull of the drawstring, the anchor point and the sheave 42 are essentially equally spaced from the two sides of the bow limb and the cable run 82 in sheave 46 is in the middle of the bow limb. In this condition, the stress on the various cables is approximately equal and at least not significantly different from the point of view torquing stress on the limbs.

When the drawstring 60 is pulled back to the point that the eccentric pulleys are overcenter and the arrow is fully drawn to a release position, the rotation of the pulleys has brought cable run 82 into the transition or switchover groove 50 and thus to the groove of intermediate sheave 44. The cable will continue to track in the intermediate sheave 44 until the bow reaches full draw regardless of the direction of rotation of the composite pulley at each end. Under this condition, the stress on the bowstring in sheave 42 is considerably lessened. This is the basic function of the compound bow. There is, however, a heavy load stress on cable 66 in the runs 80 and 82. By moving the cable 82 over to sheave 44, the stress tendency to twist the bow limb is essentially equalized. Thus, there will be no distortion of the limb and no torque reaction when the arrow is released.

In FIGS. 4 and 5, a modified composite pulley 98 is shown with equal diameter sheaves 100, 102 and 104 having an outside diameter of 1.520" and a root diameter of 1.326". The spokes 105 and 106 have shaft holes 107 and 108, respectively, at 0.326" and 0.388" from the center of the composite pulley 98. The diametrical spoke 110 has an interior passage to carry the cable 66 diametrically across the pulley and axially from sheave 104 to sheave 100 as described in connection with FIGS. 1 to 3. With the equal diameter pulleys, there will be a shorter drawlength, but otherwise the function of the pulley is the same. The cross-over or switching groove 112 carries the cable from one sheave 100 to the intermediate sheave 102 as described in connection with FIGS. 1 to 3 when the drawstring 60 is pulled to the arrow release position, the purpose being to centralize heavy stress cables in the bow limb.

As illustrated in FIG. 4, the arcs designated as 85° delineate the transition or switchover grooves 50. They are formed on each side of the vertical centerline of FIG. 4 and thus will function in either direction of rotation of the composite pulley. As viewed in FIG. 5, the groove 112 on the other side of the pulley would lie directly behind the groove 112 shown in full lines. While these angle designations need not be exactly as stated, they represent the best distribution presently utilized. The grooves in sheaves 102 and 104 extend a full 360°.

What is claimed is:

1. In a compound archery bow having:

(1) a handle member, (2) a pair of bow limbs projecting from opposite ends of the handle member and terminating in a distal end, (3) an eccentrically mounted pulley unit on a shaft at the distal end of each bow limb, (4) an anchor point at each distal end of each bow limb adjacent each pulley unit, and (5) a bowstring cable with each end connected to an anchor point at the respective distal ends of each bow limb, that improvement which comprises:

(a) a pair of pulley units having three axially spaced peripheral pulley grooves, including a first groove, and a third groove, and a second groove between said first and third grooves, and means forming a diametrical cable cross passage between the first groove and the third groove, (b) a peripheral cross-over switch groove on said pulley between said third groove and said second groove, and (c) a combination pulley cable and bowstring having a bowstring portion passing at one end around first groove at a first end of the bow and through said diametrical cross-passage to said third groove at said first end of the bow and thence to the anchor point at the second end of the bow, and the other end of said bowstring passing around first groove at the second end of said bow and through said diametrical passage to said third groove and then to the anchor point at the first end of the bow, (d) said cross-over switch groove being positioned between said third groove and said second groove whereupon rotation of said pulley units caused by a drawing of said bowstring will cause said cable to track from said third groove to said second groove so as to reduce torsion in the bow during a drawing operation by centralizing the cable on the first and second pulleys.

2. A compound archery bow as defined in claim 1 in which said anchor point at each end of said bow is positioned adjacent said third groove wherein a drawing of said bow causes said cable in said third groove to move laterally away from said anchor point to said second groove.

3. A compound archery bow as defined in claim 1 in which each of said pulley units is formed as an integral composite pulley having an eccentric axle opening, and an axle on each said bow limbs to mount a pulley unit and to serve as an anchor point.

4. A compound archery bow as defined in claim 1 in which each of said pulley units is formed as an integral composite pulley having eccentric axle openings spaced at different dimensions from the center of the pulley, and an axle on each said bow limbs to mount a pulley unit selectively in one or the other of said axle openings.

5. A compound archery bow as defined in claim 1 in which each of said pulley units has two crossover switch grooves between said third and second pulley grooves in symmetrically opposed positions to permit use for clockwise or counterclockwise rotation in said bow.

6. A compound archery bow as defined in claim 1 in which each of said pulley units is formed as an integral composite pulley having eccentric openings to receive selectively a mounting axle at the end of the bow limbs, and a pair of peripheral cross-over switch grooves on said pulleys extending for about 85° peripherally on each side of said pulley separated by about 100° peripherally of said third groove wherein said pulleys may be used at either end of said bow for clockwise or counter-clockwise rotation.

* * * * *